US005381700A

United States Patent [19]

Grosskopf, Jr.

[11] Patent Number: 5,381,700

[45] Date of Patent: Jan. 17, 1995

[54] TRAIN ANALYSIS SYSTEM ENHANCEMENT HAVING THRESHOLD ADJUSTMENT MEANS FOR UNIDENTIFIED WHEELS

[75] Inventor: George Grosskopf, Jr., Coram, N.Y.

[73] Assignee: Servo Corporation of America, Hicksville, N.Y.

[21] Appl. No.: 961,477

[22] Filed: Oct. 15, 1992

[51] Int. Cl.[6] ..... G01K 1/02; G08B 21/00; B61K 9/04

[52] U.S. Cl. ..... 73/865.9; 340/584; 340/600; 340/682; 246/169 D; 116/216

[58] Field of Search ..... 73/865.9, 593; 340/584, 340/600, 682; 246/169 A, 169 D; 116/216, DIG. 38

[56] References Cited

U.S. PATENT DOCUMENTS

| | | | |
|---|---|---|---|
| 2,963,575 | 12/1960 | Pelino et al. | 340/682 |
| 3,100,097 | 8/1963 | Woltersdorf | 340/682 |
| 3,108,772 | 10/1963 | Pelino | 340/682 |
| 3,177,359 | 4/1965 | Bramer et al. | 340/584 |
| 3,206,596 | 9/1965 | Howell | 340/682 |
| 3,226,540 | 12/1965 | De Priest | 246/169 D |
| 3,539,810 | 11/1970 | Pettitt et al. | 246/169 D |
| 3,546,447 | 12/1970 | Thompson et al. | 246/169 D |
| 3,646,343 | 2/1972 | Caulier et al. | 246/169 D |
| 3,697,744 | 10/1972 | Howell | 246/169 D |
| 3,731,087 | 5/1973 | King | 246/169 D |
| 3,812,343 | 5/1974 | Gallagher et al. | 73/9 |
| 4,050,292 | 9/1977 | Bloch | 73/593 |
| 4,256,278 | 3/1981 | Sanville | 246/169 D |
| 4,313,583 | 2/1982 | Bambara et al. | 246/169 D |
| 4,323,211 | 4/1982 | Bambara et al. | 340/584 |

FOREIGN PATENT DOCUMENTS

| | | | |
|---|---|---|---|
| 246006 | 7/1963 | Australia | 246/169 D |
| 1031338 | 6/1958 | Germany | 246/169 D |
| 1082618 | 6/1960 | Germany | 246/169 D |
| 1131254 | 6/1962 | Germany | 246/169 D |
| 578212 | 10/1977 | U.S.S.R. | 246/169 A |
| 677971 | 8/1979 | U.S.S.R. | 246/169 A |

*Primary Examiner*—Robert Raevis
*Assistant Examiner*—Daniel S. Larkin
*Attorney, Agent, or Firm*—Kane, Dalsimer, Sullivan, Kurucz, Levy, Eisele and Richard

[57] ABSTRACT

A train analysis system for analyzing a wheel condition such as wheel bearing temperature includes circuitry for identifying the wheels of a railroad car, circuitry for averaging the condition of each wheel of a car, and circuitry for establishing a threshold level for said condition, dependent on said averaging. When a wheel cannot be identified, a threshold level is set which is below the maximum level for identified wheels.

10 Claims, 2 Drawing Sheets

TRAIN ANALYSIS SYSTEM ENHANCEMENT HAVING THRESHOLD ADJUSTMENT MEANS FOR UNIDENTIFIED WHEELS

BACKGROUND OF THE INVENTION

A. Field of Invention

This invention pertains to an apparatus for analyzing railroad car wheels to detect certain conditions which may result in a derailment, and more particularly to a system which performs the analysis after data has been collected from a moving car.

B. Description of the Prior Art

Derailments on railroads cause major problems because they may result in injuries, loss of life and they are also very expensive and cause extreme time delay. Since derailments are caused very often by either hot wheels or hot wheel bearings, extensive wheel monitoring systems have been installed for monitoring the wheel temperatures. These temperatures are then compared to certain threshold levels and if the temperature of a wheel (or bearing) exceeds a threshold, an abnormal condition is established. The level of the threshold is critical to the operation of the railroad. If this level is too high, an overheated wheel or bearing may not be detected until a derailment occurs. If the level is set too low, a false alarm may be generated. False alarms resulting in a stopped train are more tolerable then derailments because they normally do not result in loss of life or property, however they still cause delays, complications in train schedules and consequently are very expensive.

Some systems are known in which the temperature thresholds are not fixed but are adjusted dynamically between an absolute minimum and an absolute maximum level. For example the temperatures of all the wheels of a car, or train, could be averaged and then the threshold can be calculated using this average. However, this procedure requires the capability of identifying, differentiating and associating the wheels to a car. In the prior art systems, if a wheel is not identified as being associated with a particular car, then the absolute threshold level is used for the comparison. However, this solution is unsatisfactory because it may lead either to derailments due to missed hot bearings or false alarms and the absolute alarm thresholds cannot be modified to make effective use of alarm criteria based on car average temperatures.

OBJECTIVES AND SUMMARY OF THE INVENTION

In view of the above-disadvantages of the prior art, it is an objective of the present invention to provide a system which dynamically adjusts a temperature threshold, with means for handling unidentified wheels.

A further objective is to provide a method of handling unidentified wheels which is readily integrated into existing systems.

Other objectives and advantages of the invention shall become apparent from the following description. A train analysis system constructed in accordance with this invention includes a scanner for detecting a preselected condition of a wheel bearing and means of associating a group of wheels/axles to a particular car. If the wheel is not associated with a particular car (referred to as unidentified axles), the absolute and differential alarm thresholds can be reduced (by a user selection) below the maximum threshold for identified wheels.

DETAILED DESCRIPTION OF THE INVENTION

Figure 1:
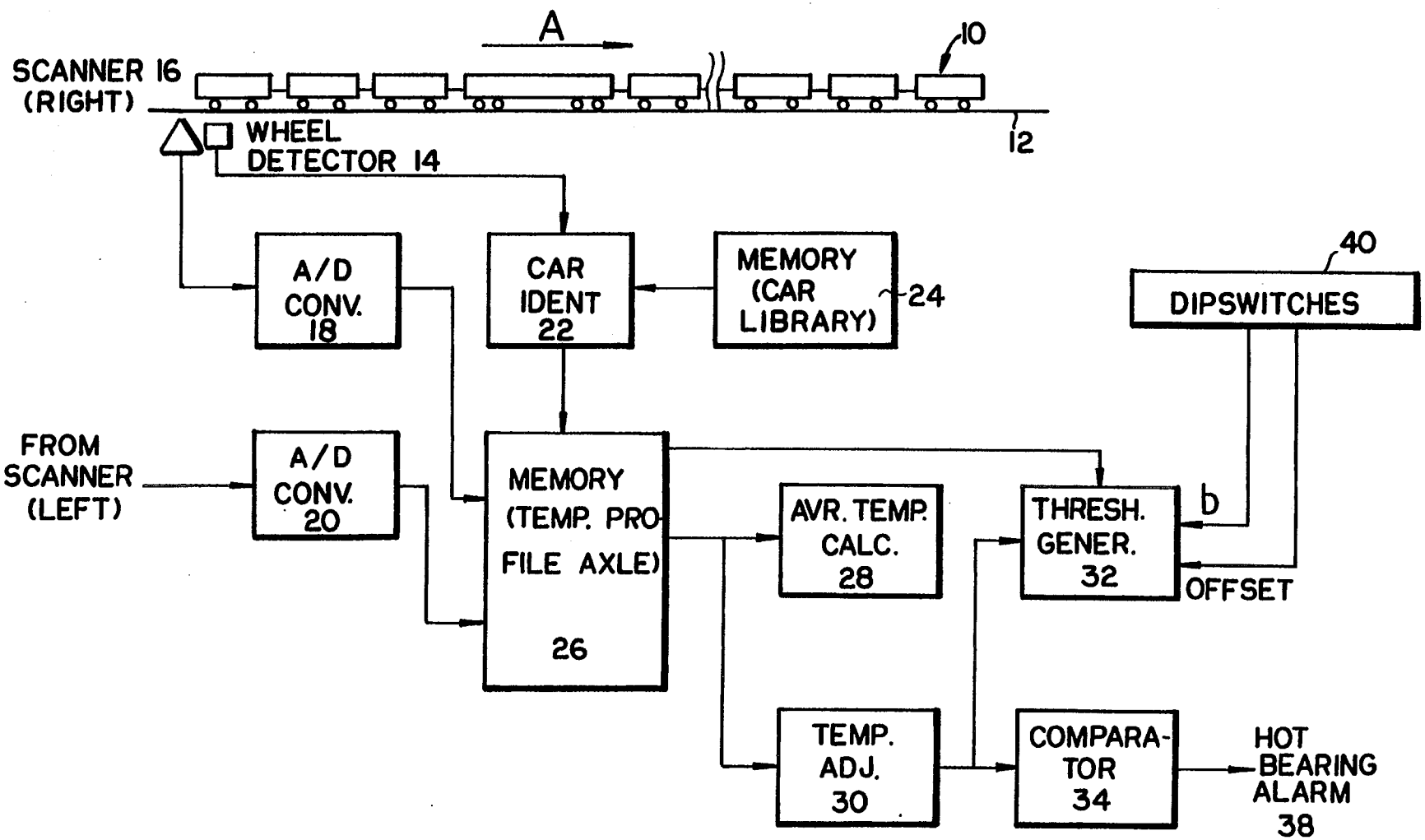
FIG. 1 shows a block diagram of a train analysis system constructed in accordance with the present invention.

In FIG. 1 a train 10 is illustrated somewhat schematically as running on a rail 12 in the direction indicated by arrow A. The cars making up train 10 may have different lengths and different number of axles, with two wheels and wheel bearings on each axle (on opposite sides). Adjacent to rail 12 are two detectors: a wheel detector 14, and a scanner 16. Such detectors and scanners are well know to those skilled in the art and may, for example, be constructed as disclosed in U.S. Pat. Nos. 3,095,171; 3,408,493 or 3,545,005 . Scanner 16 monitors the temperature of the wheel bearings as the wheels run by, and provides a signal indicative of this bearing temperature to an a/d converter 16. A similar scanner (not shown) is disposed on the other side of the train to monitor the bearings of the left wheels. The output of this scanner is fed to another a/d converter 20.

The remaining portions of the system are best implemented by using a digital microprocessor. However, for the sake of clarity the system is described as having discrete components or circuits. Wheel detector 14 is used to generate a signal indicative of each wheel to a car identifier circuit 22. Circuit 22 determines the spacing between the wheels. The system is initially set up with information describing various cars by the spacing between the wheels. Circuit 22 uses this information and the spacing the wheels to identify each car of train 10 including the number of its axles, the type of bearings (i.e. plain or roller bearings) which is determined as the train passes the scanner 16 by the heat wave form and so on. The temperature of each wheel bearing, its axle number and the corresponding car information is all stored in a memory 26. Thus, memory 26 contains a whole temperature profile for the wheel bearings.

When all the cars of the train 10 have rolled past the detector 14 and scanner 16, the system proceeds to determine if any of its wheel bearings are hot as follows. It should be understood that the circuits shown in FIG. 1 may be implemented using a digital microprocessor, and they are shown as discrete circuits for the sake of clarity. First, an average temperature calculator circuit 28 recalls all the bearing temperatures from memory 26 and calculates separately the average temperatures on each rail of wheels bearing, regardless of bearing type. The two values are identified as:

R1TSA (Rail 1 Train Side Average)

R2TSA (Rail 2 Train Side Average)

During this calculation, if any of the bearing temperatures exceed a maximum alarm level (either absolute or differential (described below) they are excluded.

Circuit 28 also calculates the following two heat compensation factors, wherein the digits 1 and 2 indicate the rail numbers:

$$R1HCF=0.5(1+(R2TSA/R1TSA))$$

$$R2HCF=0.5(1+(R1TSA/R2TSA))$$

These compensation factors are fed to a temperature adjusting circuit 30 which also recalls each of the bearing temperatures from memory 26 and multiplies it with the appropriate compensating factors defined above; thereby normalizing the entire train.

Next, a threshold generator circuit 32 is used to generate a threshold level. For this purpose, circuit 32 obtains from memory 26 a list of all the wheels belonging to a particular car. Circuit 32 then get from circuit 30 the compensated bearing temperature for each wheel of that particular car, and generates therefrom average car bearing temperature (ACBT). In this scheme, if a particular compensated bearing temperature is below a minimum level, the compensated bearing temperature for that bearing may be assigned a minimum value.

After the average car bearing temperature has been calculated, circuit 32 calculate a threshold level for that car. More particularly, for low average car temperatures the threshold level is generated using the formula:

Threshold (car)=b*ACBT+abs.min.

where $0.5<b<5$ and abs. min. is an absolute minimum threshold level which is determined empirically and selected by a user.

Figure 2:
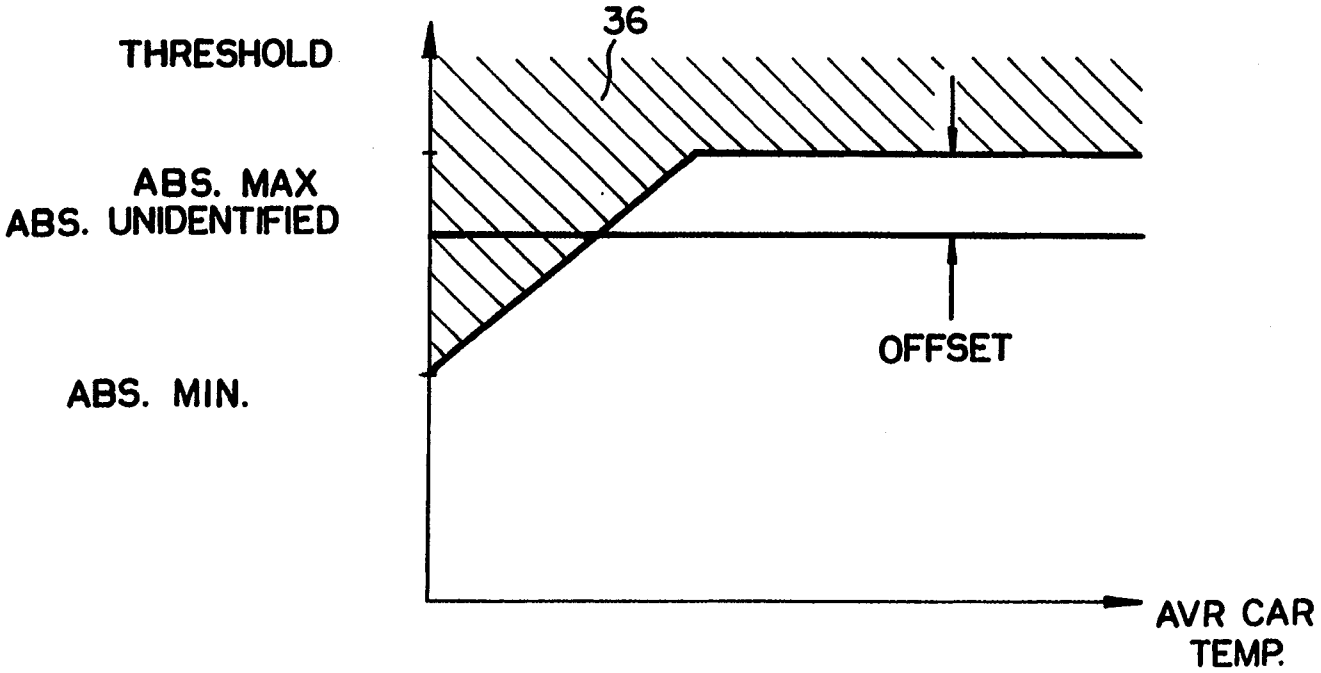
FIG. 2 shows a graph for the temperature threshold selection used by the system of FIG. 1.

As seen in FIG. 2, the threshold level increases linearly, as selected by the user, with ACBT until an absolute maximum (abs. max) threshold level is reached. Thereafter, the threshold level remains at abs. max. Again the value of abs. max. is determined empirically and selected by a user.

Finally, for each identified wheel, its compensated wheel bearing temperature is compared by comparator 34 to the threshold level generated by circuit 32. If this temperature is equal to or exceeds this threshold level, i.e. it falls into shaded area 36 in FIG. 2, then a hot bearing alarm signal 38 is generated by the system.

As described above, sometimes one or more wheels cannot be identified as belonging to a particular car. This may occur for example if the characteristics of a car are not in the car library of memory 24; if the wheel transducer generates a spurious pulse, or fails to generate a pulse because of noise; or if the train 10 is accelerating rapidly. When circuit 32 determines that a wheel is unidentified, it generates an unidentified threshold level by reducing the absolute maximum level by a preselected offset as shown in FIG. 2. This level is then used by comparator 34 as the reference value against the bearing temperature from circuit 30.

The values of b and the offset can be preset by the manufacturer of the system, or may be selectable by a customer, for example by using DIP switches 40.

The above description shows in detail a typical wheel bearing temperature monitoring system with means for handling unidentified wheels. Obviously, the same techniques may be adapted to systems using other types of monitoring systems. Moreover, modifications can be made to the invention without departing from its scope as defined in the appended claims.

I claim:

1. A train analysis system comprising:

detector means disposed adjacent to a railroad track for detecting a condition of a wheel as a train passes the detector means;

wheel identifying means for identifying said wheel;

threshold generating means for generating a first threshold level related to an absolute threshold when said wheel is identified as being part of a particular car, and for generating a second threshold level different from said absolute threshold when said wheel is not identified as being part of a particular car; and comparing said condition to one of said first and second threshold level.

2. The system of claim 1 wherein said comparing means generates an alarm signal when said condition is above one of said first and second threshold levels.

3. The system of claim 1 wherein said condition is a bearing temperature.

4. The system of claim 1 wherein said condition is a wheel temperature.

5. The system of claim 1 further comprising wheel detecting means for generating pulses coincident with said wheels, wherein said wheel identifying means identifies said wheel in accordance with said pulses.

6. The system of claim 5 wherein said train of at least one type of car, and said wheel identifying means identifies said wheel as belonging to said one type of car.

7. A train analysis system comprising:

wheel sensor means for sensing a condition of wheels on a train;

memory means for storing the condition of each wheel;

identifying means for identifying each wheel as wheel having a predetermined characteristic;

threshold generating means for generating a first threshold level related to an absolute threshold when said wheel is identified, and for generating a second threshold level different from said absolute threshold when said wheel is not identified; and comparing said condition to one of said first and second threshold level.

8. The system of claim 7 further comprising averaging means for obtaining an average condition for all wheels having said characteristic, said threshold generating means generating said first threshold level as a function of said average condition.

9. The system of claim 7 wherein said condition is bearing temperature.

10. The system of claim 7 wherein said identifying means identifies all the wheels of a car.

* * * * *